US007014422B2

(12) United States Patent
Hancock

(10) Patent No.: US 7,014,422 B2
(45) Date of Patent: Mar. 21, 2006

(54) ROUNDED BLOWER HOUSING WITH INCREASED AIRFLOW

(75) Inventor: Stephen S. Hancock, Flint, TX (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/461,042

(22) Filed: Jun. 13, 2003

(65) Prior Publication Data

US 2004/0253092 A1 Dec. 16, 2004

(51) Int. Cl.
*F03B 1/04* (2006.01)

(52) U.S. Cl. ..... 415/204; 415/206

(58) Field of Classification Search ..... 415/1, 415/204, 206, 224
See application file for complete search history.

(56) References Cited

U.S. PATENT DOCUMENTS

| | | | | |
|---|---|---|---|---|
| 3,145,912 A | | 8/1964 | Weis | |
| 3,811,790 A | | 5/1974 | Mikulina et al. | |
| 3,846,040 A | * | 11/1974 | Dennis | 415/204 |
| 4,865,517 A | | 9/1989 | Beehler | |
| 4,913,621 A | | 4/1990 | Reither | |
| 5,064,315 A | | 11/1991 | Samejima et al. | |
| 5,069,599 A | * | 12/1991 | Carretta | 415/204 |
| 5,112,190 A | * | 5/1992 | Kajiwara et al. | 415/206 |
| 5,141,397 A | | 8/1992 | Sullivan | |
| 5,279,515 A | | 1/1994 | Moore et al. | |
| 5,570,996 A | | 11/1996 | Smiley, III | |
| 2002/0056453 A1 | | 5/2002 | Klopp et al. | |
| 2003/0202877 A1 | | 10/2003 | Kamiya et al. | |

FOREIGN PATENT DOCUMENTS

FR 2 742 813 12/1995

OTHER PUBLICATIONS

Publication: "The Leader", Title: "New Air Handler Features Better Performance in a Smaller Cabinet", Spring 2004, p. 6, vol. 13, Issue 1.

* cited by examiner

*Primary Examiner*—Theresa Trieu
(74) *Attorney, Agent, or Firm*—William J. Beres; William O'Driscoll

(57) ABSTRACT

A blower housing. The blower housing comprises an axis about which the blower housing is oriented; an inlet allowing the entrance of fluid in an axial direction for the blower housing; a discharge for the blower housing discharging fluid in a radial direction; a cutoff for the blower housing extending in the axial direction and located in the vicinity of the outlet; and a fluid flow path extending from the cutoff to the outlet. The fluid flow path is open in a radial inward direction to the axis to receive fluid from the inlet. The fluid flow path has a progressively increasing cross-sectional area, and the fluid flow path alternately expands and contracts in the radial and axial directions.

47 Claims, 7 Drawing Sheets

10
12
14
16
18
20
22
24
26
27
28
30
32
34
36
40
42
43
4
I
II
III
70
72
73
74
76
80
82
84
85
90
92
94
110
120
124
126
128
138
A
B
R

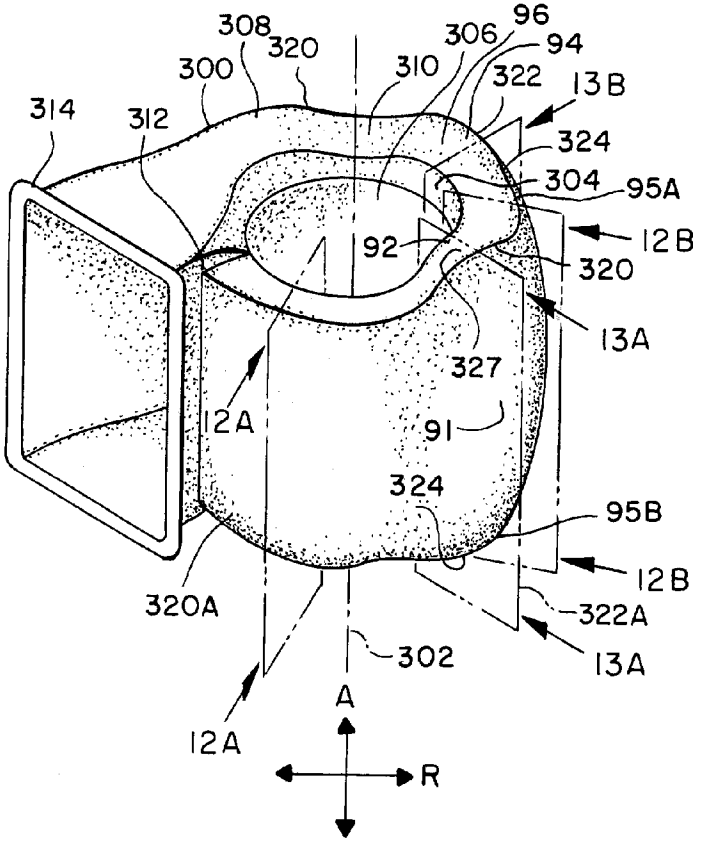
FIG. 11
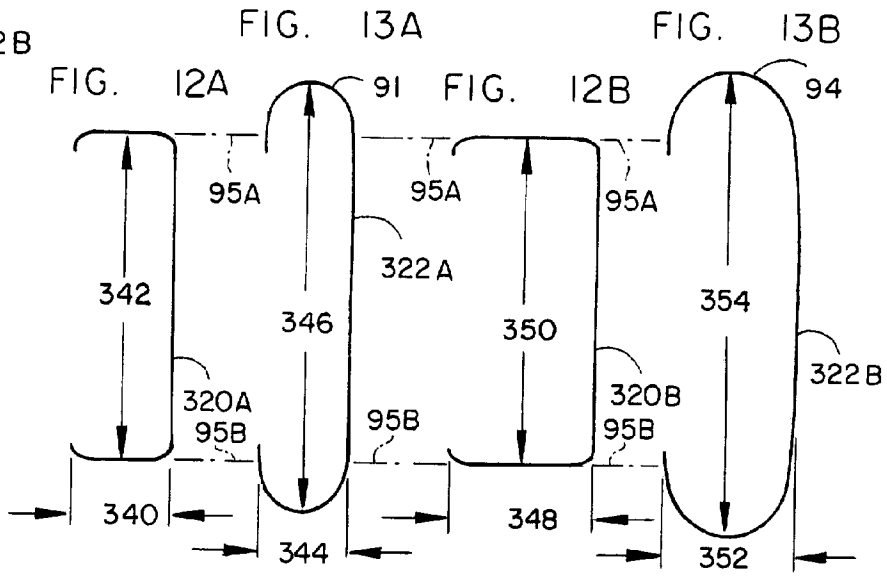

ROUNDED BLOWER HOUSING WITH INCREASED AIRFLOW

BACKGROUND OF THE INVENTION

The present invention is directed to improved blower housings of the type used in centrifugal or air foil fans. More specifically, the present invention contemplates a blower housing whose radial and axial dimensions are substantially independent of increased cross-sectional area in the discharge path relative to previous blowers and thereby provides a quieter, more efficient blower with increased airflow in the same physical dimensions. For purposes of this invention, the term 'blower' also includes fans, impellers and other fluid moving devices.

Previous blowers, such as that shown in U.S. Pat. No. 5,279,515 to Moore et al., include a scroll housing which expands from a cutoff in a continuous and smoothly increasing radial dimension from that cutoff to a discharge outlet. The scroll housing is enclosed by a pair of substantially flat side walls to enclose a blower and to form a discharge plenum. The discharge plenum is outside of the blower's periphery and inside of the scroll housing and sidewalls. The plenum is characterized by a continuously increasing cross-sectional area basically formed by the radial expansion of the scroll housing away from the periphery of the impeller. This discharge plenum is defined by a rectangular footprint in a plane perpendicular to the axis of the blower and having edges tangent to the scroll housing at locations spaced approximately 90° from each other.

U.S. Pat. No. 5,570,996 to Smiley, III shows a variation where the scroll housing has a conformal portion of constant radius preceding the expansion portion of the scroll housing.

It would be desirous to increase the cross-sectional area of the discharge plenum while reducing its surface area without increasing the rectangular footprint.

SUMMARY OF THE INVENTION

It is an object, feature and advantage of the present invention to improve previous blowers.

It is an object, feature and advantage of the present invention to provide a blower airflow path which continuously increases in cross-sectional area from the blower to the discharge. It is a further object, feature and advantage of the present invention to provide an airflow path which changes cross-sectional shape. It is a further object, feature and advantage of the present invention to provide a blower housing which does not always expand continuously in a radial or axial direction relative to the axis of the blower as the housing progresses from the cutoff to the discharge.

It is an object, feature and advantage of the present invention to provide a blower which alternates increases in the radial and axial dimensions as the housing progresses from the cutoff to the discharge. It is a further object, feature and advantage of the present invention that the cross-sectional area of the discharge plenum expand continuously and smoothly from the cutoff to the discharge as this alternation of expansion in radial and axial dimensions occurs.

It is an object, feature and advantage of the present invention to accomplish the same expansion as previous housings with less surface area. It is a further object, feature and advantage of the present invention to reduce material, cost and drag in comparison to previous housings.

It is an object, feature and advantage of the present invention to provide a fan or blower housing that expands and contracts axially and radially such that the enclosed area expands continuously.

It is an object, feature and advantage of the present invention to increase the cross-sectional area of a blower discharge path without increasing the footprint of the blower.

The present invention provides a blower housing. The blower housing comprises a housing having a discharge path portion that expands and contracts axially and radially and an enclosed area formed by the discharge path portion having a cross-sectional area that expands continuously from a start to an end.

The present invention still further provides a blower housing comprising: an inlet; an outlet; a cutoff; and a housing including the inlet, the outlet, and the cutoff. The housing extends from the cutoff to the outlet in a first cross-sectional shape. At least a first aberrant portion of the housing changes from the first cross-sectional shape to a second cross-sectional shape, and then resumes the first cross-sectional shape.

The present invention also provides a blower housing comprising: an axis about which the blower housing is oriented; an inlet allowing the entrance of fluid in an axial direction for the blower housing; a discharge for the blower housing discharging fluid in a tangential direction; a cutoff for the blower housing extending in the axial direction and located in the vicinity of the outlet; and a fluid flow path extending from the cutoff to the outlet. The fluid flow path is open in a radial inward direction to the axis to receive fluid from the inlet, and the fluid flow path has a progressively increasing cross-sectional area. The fluid flow path alternately expands in the radial and axial directions.

The present invention further provides an air flow path comprising: an axis; a housing oriented about the axis; at least a first inlet centered about the axis in the housing; an outlet in the housing; and an airflow path between the inlet and the outlet. The airflow path includes an entrance portion wherein airflow is generally parallel to the axis, a blower portion where airflow is perpendicular to the axis, and a scroll portion where the airflow is spiraling around the axis in a tangentially increasing path. A housing forms the inlet and the outlet and has an air path portion enclosing the airflow path. The air path portion has first and second cross-sectional shapes oriented radial to the axis. Each shape has a radial and an axial dimension. The radial dimension of the first cross-sectional shape increases in direct proportion to the area enclosed by the shape. The axial dimension of the second cross-sectional shape increases in direct proportion to the area enclosed by the shape.

The present invention additionally provides a blower housing comprising an airflow path; and a housing arranged about and forming the airflow path. The housing has a first cross-sectional portion of the airflow path in a first shape. The housing has a second cross-sectional portion of the airflow path in a second shape geometrically distinct from the first shape. In addition, as the housing progresses from its cutoff to discharge, it may employ further distinct shapes to enclose its continuously expanding cross-sectional area.

The present invention still further provides an air moving apparatus comprising a blower for moving air and a housing arranged about the blower. The blower includes a blower inlet and a blower outlet. The housing has a housing inlet for providing air to the blower inlet and a housing outlet for receiving air from the blower outlet. The housing forms an airflow path from the blower outlet to the housing outlet. The airflow path has a cross-sectional area which progressively increases from the housing cutoff to the housing outlet. The housing has a first radial portion wherein the housing expands in a radial direction. The airflow path includes further portions in which the radial expansion slows as axial expansion accelerates and other portions in which the radial expansion slows or reverses as the axial expansion accelerates.

The present invention moreover provides a method of directing air from a blower discharge inlet to a blower discharge outlet comprising the steps of: a discharge housing extending from the discharge inlet to the discharge outlet; providing a first cross-sectional shape to the discharge housing; providing a second cross-sectional shape to the discharge housing where the second cross-sectional shape differs from the first cross-sectional shape; increasing a radial dimension of the discharge housing wherever the first cross-sectional shape is provided; and maintaining or decreasing the radial dimension of the discharge housing whenever the second cross-sectional shape is provided.

BRIEF DESCRIPTION OF THE DRAWINGS

FIG. 11 is a perspective diagram of the second preferred embodiment of the present invention.

FIGS. 12A and B are cross-sectional views respectively taken along lines 12*a*—12*a* and 12*b*—12*b* of FIG. 11.

FIGS. 13A and B are cross-sectional views respectively taken along lines 13*a*—13*a* and 13*b*—13*b* of FIG. 11.

DETAILED DESCRIPTION OF THE DRAWINGS

Figures 1, 2:
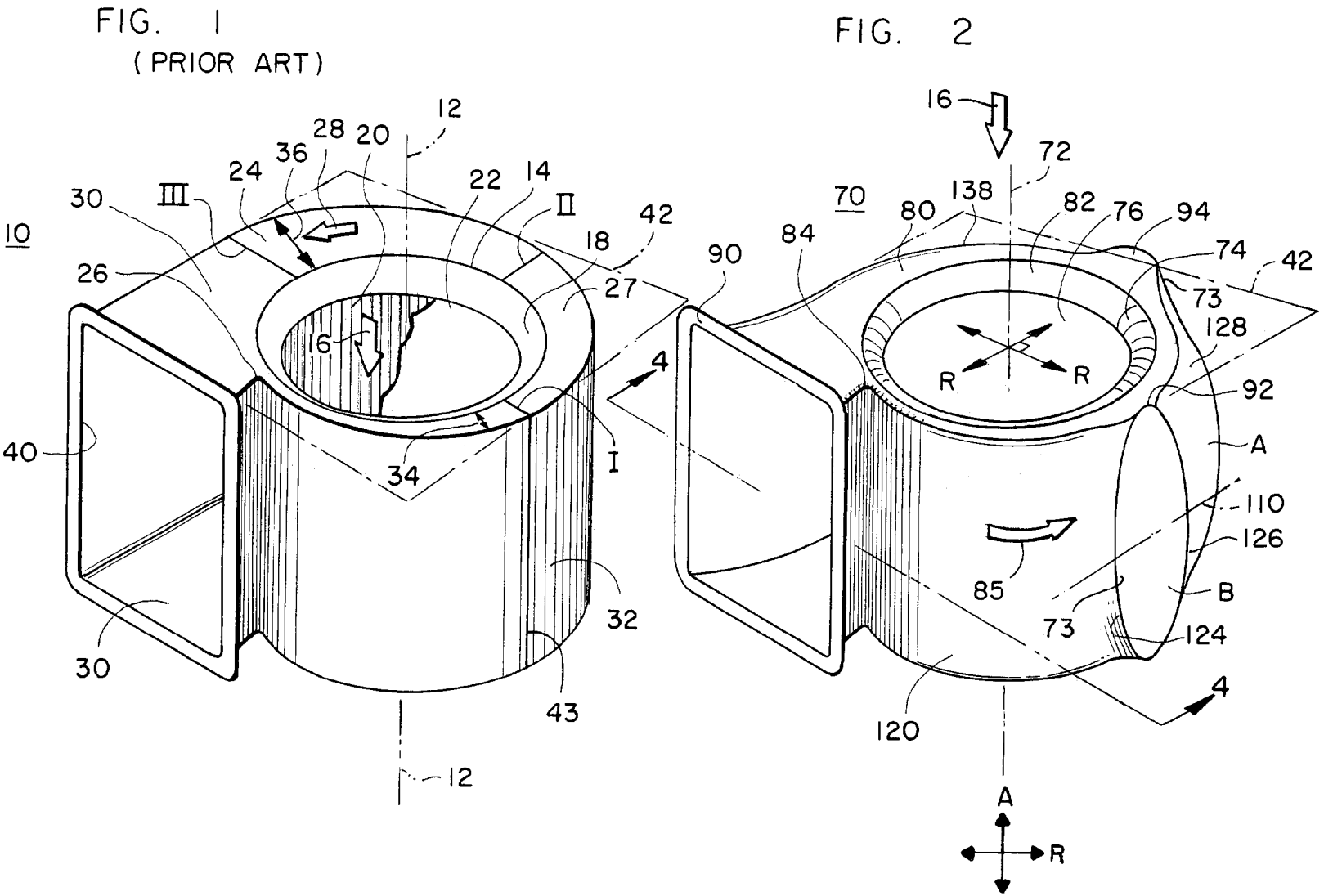
FIG. 1 (PRIOR ART)
FIG. 1 is a perspective diagram of a conventional blower.
FIG. 2 is a perspective diagram of a first preferred embodiment of the improved blower of the present invention.

FIG. 1 shows a conventional blower housing 10. The blower housing 10 is oriented about an axis 12 and is typically formed of sheet metal or molded plastic but can be formed of any suitable material. An inlet 14 is oriented about the axis 12 and allows a fluid such as air to enter the blower housing 10 in a direction generally parallel to the axis 12 as indicated by arrow 16. A rounded entrance 18 to the inlet 14 is provided to smooth airflow. A blower 20 oriented around the axis 12 and radially spaced therefrom receives the air from the inlet 14, turns the air into a direction perpendicular to the axis 12 and propels the air through the blades 22 of the blower 20 into a discharge plenum or path 24. The discharge path 24 commences at a cutoff 26 and travels in an expanding scroll shaped path 27 around the blower 20 as indicated by arrow 28. The housing 10 includes a pair of end plates 30 and a spiral portion 32 enclosing the discharge plenum 24. The scroll portion 32 expands continuously in a radial direction relative to the axis 12 such that a radial dimension 34 in the airflow path 27 near the cutoff 26 is less than a radial dimension 36 in the airflow path 27 near an outlet 40 of the housing 10. Basically, previous scroll type blowers are characterized by continuous radial expansion of the discharge plenum 24 as the discharge plenum 24 travels from the cutoff 26 to the outlet 40. The blower housing 10 has an area defined by a footprint 42, where this area lies in a plane perpendicular to the axis 12. The footprint 42 of the blower 20 is shown as a box in a plane perpendicular to the axis 12 and enclosing the blower housing 10. The footprint 42 contacts the scroll portion at tangents I, II and III. These tangents I, II and III are spaced approximately 90° from each other relative to the axis 12. At any given location, a cross-sectional area of the discharge path is defined by its radial dimension 34, 36 times an axial dimension 43 between the end plates 30.

One feature of the present invention is directed to increasing the cross-sectional area of the discharge plenum without increasing the size of the footprint. Essentially, this is accomplished by either changing the cross-sectional shape or axially expanding the blower housing in the vicinity of the tangent points I, II, III.

Figure 8:
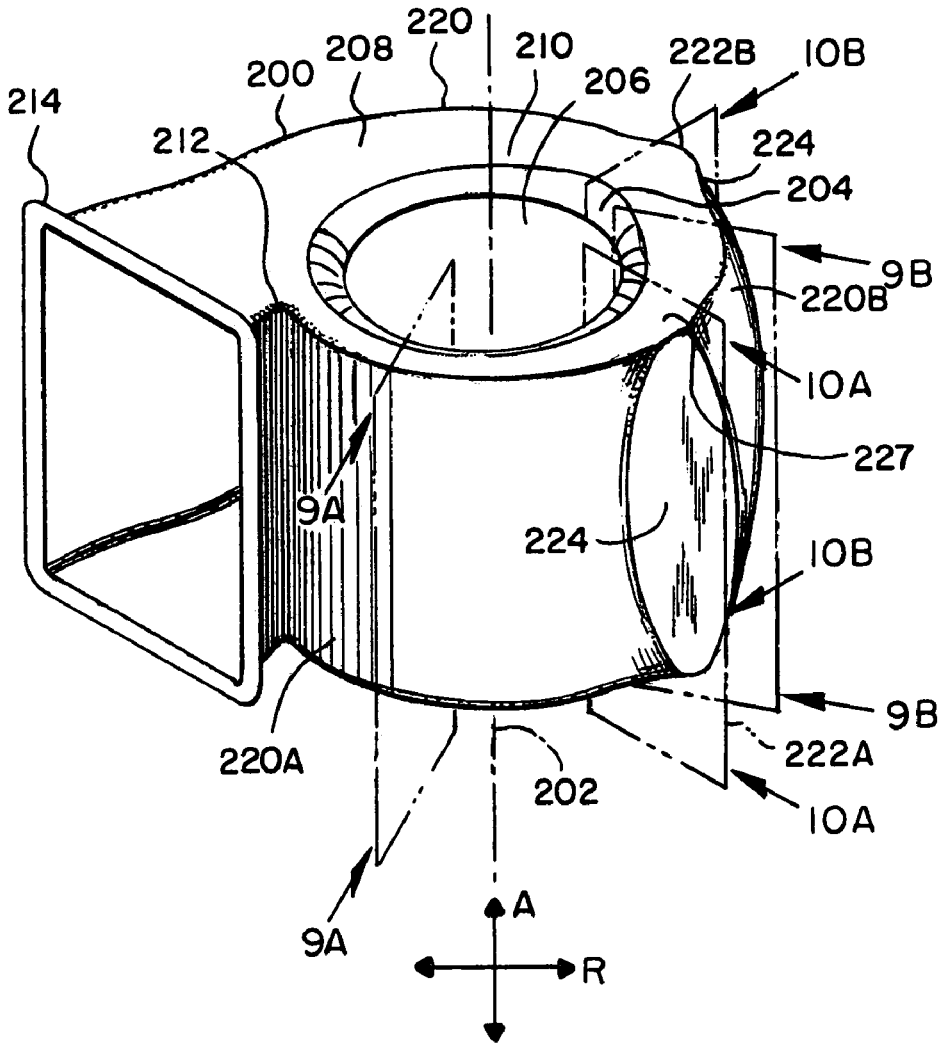
FIG. 8 is a perspective diagram of the first preferred embodiment of the improved blower of the present invention.
Figure 10B:
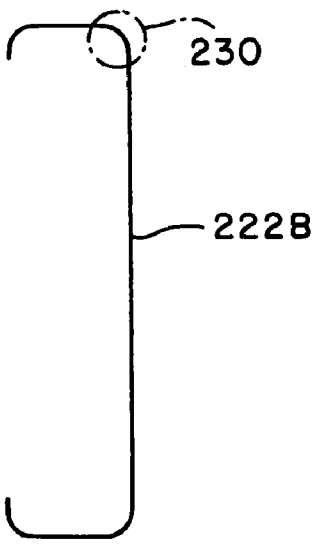
FIG. 10B is a cross-sectional view taken along lines 10B—10B of FIG. 8.
Figure 9B:
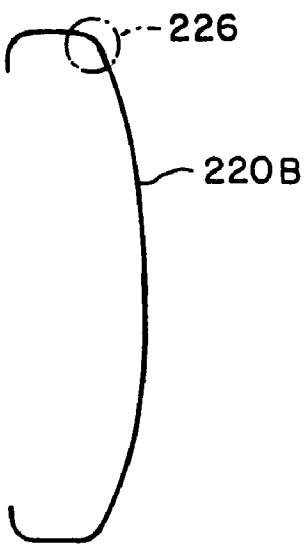
FIG. 9B is a cross-sectional view taken along lines 9B—9B of FIG. 8.
Figure 10A:
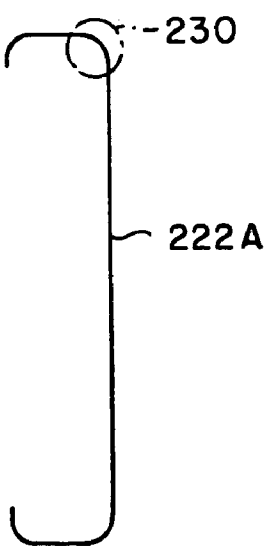
FIG. 10A is a cross-sectional view taken along lines 10A—10A of FIG. 8.
Figure 9A:
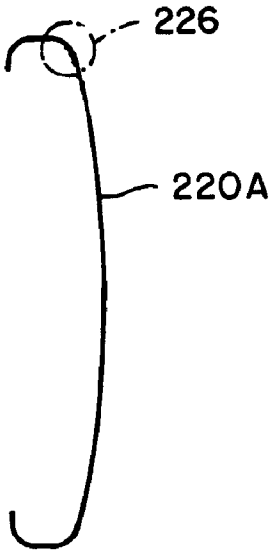
FIG. 9A is a cross-sectional view taken along lines 9A—9A of FIG. 8.

In a first preferred embodiment shown in FIGS. 2, 8, 9 and 10, the cross-sectional shape of the airflow path, as best seen in comparison of FIGS. 9A and 9B with FIGS. 10A and 10B, preferably changes from a first rectangular shape to a second elliptical shape, then generally returns to the first rectangular shape. Of course, although the first shape is generally rectangular and the second shape is generally elliptical, the first and second shape will increase in their radial dimensions as the shape's location moves away from the cutoff and towards the discharge. For purposes of this invention, arrows labeled R indicate radial directions relative to the blower axis while arrows labeled A indicate axial directions relative to the blower axis.

FIG. 2 shows the first preferred embodiment of the improved blower housing 70 of the present invention. The blower housing 70 is oriented about an axis 72 with an inlet 74 radially arranged about the axis 72 and a blower 76 radially spaced from the axis 72. The blower 76 is rotated about the axis 72 by some external means such as a motor (not shown) and draws air through the inlet 74 in an axial direction 16 or A and then turns the air into a radial direction R perpendicular to the axis 72 so that the air is moved through the blower 76 into a discharge plenum 80. A discharge airflow path 82 in the discharge plenum 80 commences at a cutoff 84 and travels in a direction 85 around the blower 82 to a discharge outlet 90.

Like a conventional blower, the discharge airflow path 82 has a cross-sectional area which expands continuously. However, unlike a conventional blower, the discharge airflow path 82 alternates between expanding in a radial direction and expanding by changing a cross-sectional shape as shown by areas of shape expansion 92, 94. The areas of shape expansion 92, 94, wherein the corners of the blower housing 70 are expanded in an axial direction relative to the axis 72, are preferably located in approximately the same regions as the tangent lines I and II of a conventional blower. These areas of shape expansion 92, 94 allow the cross-sectional area of the discharge airflow path 82 to increase at a faster rate than the corresponding cross-sectional areas of the discharge airflow path 24 of a conventional blower without increasing the blower footprint 42. The shape expansion may result in planar portions 73 lying on the footprint on tangent lines I and II.

Figure 3:
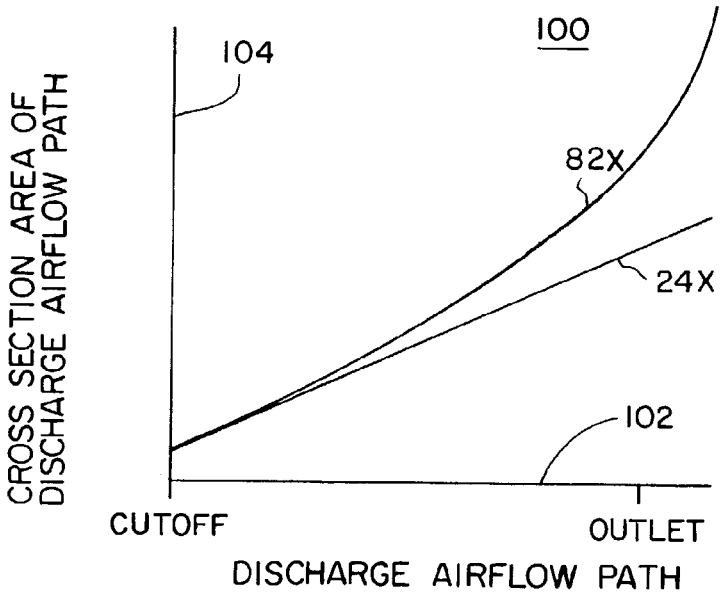
FIG. 3 is a graph of the cross-sectional area of the discharge airflow path for each of the blowers of FIGS. 1 and 2.

This contrast is graphically illustrated in FIG. 3. FIG. 3 is a graph 100, not to scale, of locations in the discharge airflow path 82 from the cutoff to the discharge as illustrated by the ordinate 102 versus the cross-sectional area of the discharge airflow path 82 at the selected location as illustrated by the abscissa 104. The cross-sectional area of the discharge airflow path 24 for the conventional blower of FIG. 1 is illustrated by the line 24X. The increased cross-sectional area of the discharge airflow path 82 of the improved blower of the present invention is illustrated by line 82X. The overall result of the improvement is that the discharge airflow path 82X is larger in cross-sectional area than a similar discharge airflow path 24, allowing a greater volume of air to be moved within the same footprint 42. Consequently, the improved blower can move more air, or can move the same amount of air but more quietly.

Figure 4:
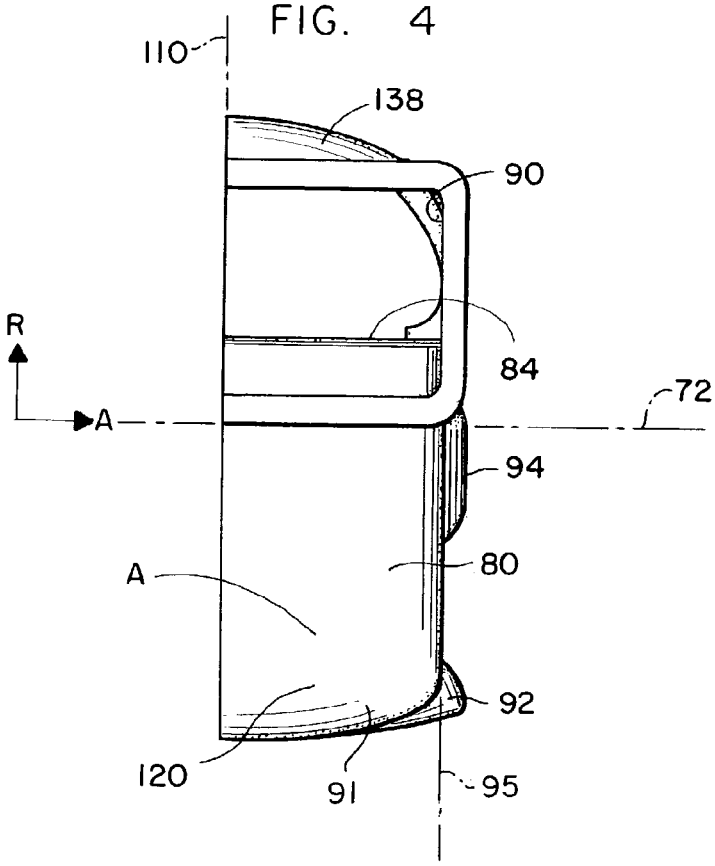
FIG. 4 is a view of a second preferred embodiment of an improved blower of the present invention, viewing the discharge.
Figure 5:
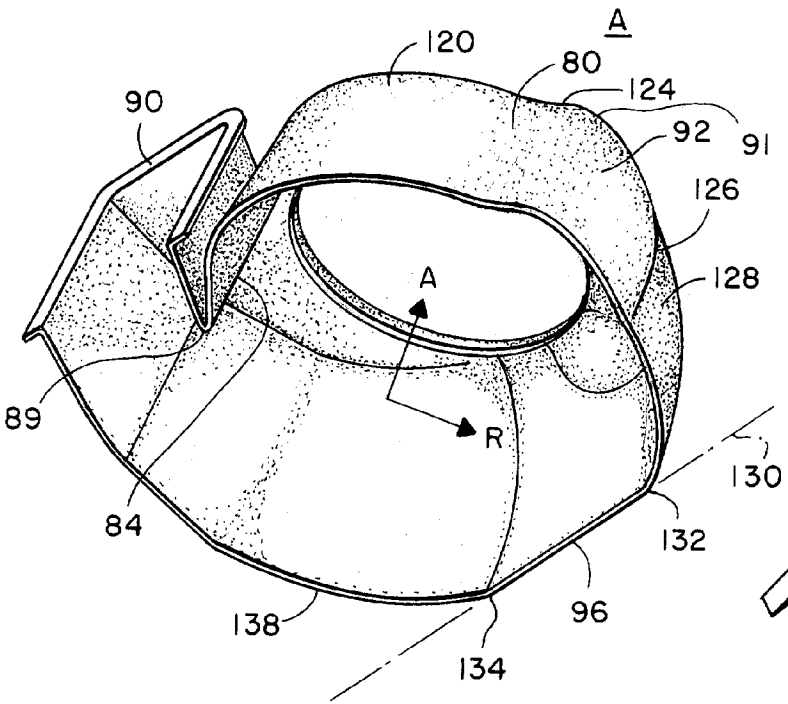
FIG. 5 is a perspective view of the blower of FIG. 4 viewing the inside of the blower housing.
Figure 6:
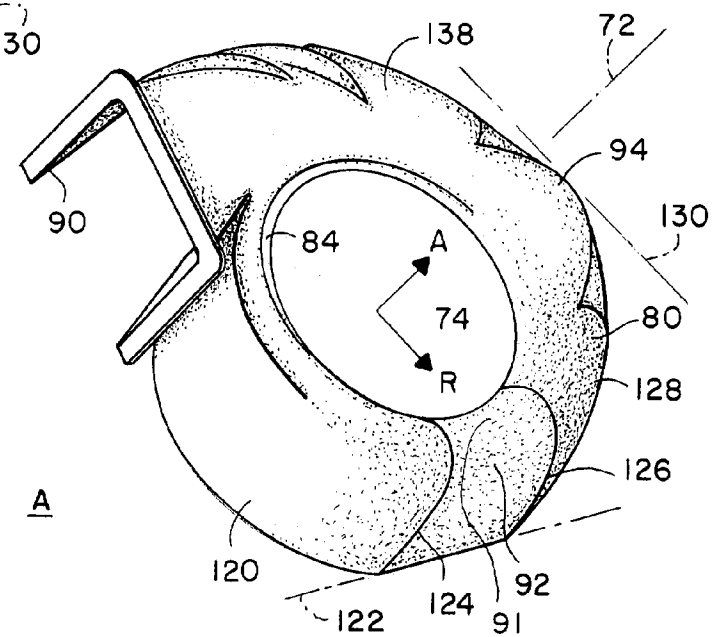
FIG. 6 is a perspective view of the outside of the blower housing of FIG. 4.

FIGS. 4–6 show a second preferred embodiment of the present invention as shown in FIGS. 11–13. Although the preferred embodiments are described in terms of a blower formed from mirror image halves, it should be recognized that half blowers are known where the half blower of either mirror image is positioned against a flat surface (not shown) and is used to provide air movement. In the second preferred embodiment of the present invention the axial dimension of the blower increases whenever the blower housing approaches the edge of the footprint while the radial dimension is maintained or decreases. In this second preferred embodiment like numbers are used to illustrate like parts.

For ease of manufacturing, the blower housing 70 is typically formed in two parts A and B which (with the exception of fastening devices and attachments, not shown) are in general mirror images taken about a plane 110 perpendicular to the axis 72 shown in FIGS. 2 and 4. These halves A and B are illustrated with respect to half A in FIGS. 4–6 while a full blower is shown in FIG. 11. Referencing 4–7, it can be seen that the discharge plenum 80 commences at the cutoff 84 and includes a radial expansion portion 120 expanding at a continuous radial rate from the axis 72 from the cutoff 84 until a line 122 representing an edge portion of the footprint 42 is contacted. As indicated by the transitional portion 124 in the housing 172, the cross-sectional area changes to a different geometric shape wherein the axial dimension parallel to the axis 72 expands while at the same time the radial dimension slightly decreases. The cross-sectional area continues to increase as generally indicated by the line 82X of graph FIG. 3. Once a transitional area 126 is reached indicating that the housing 70 is about to cease contact with the line 122 representing the footprint edge, axial expansion reverses and the radial expansion is resumed in the area 128. This radial expansion continues until a line 130 representative of the footprint 42 is contacted at a transition area 132. At transition area 132, the axial expansion again commences in area 96 so that the cross-sectional area of the discharge plenum continues to expand continuously and smoothly as indicated by line 82X of FIG. 3. At a transition area 134 contact with the footprint line 130 ends, axial expansion again reverses, and the housing returns to a further radial expansion in area 138 running from the transitional area 134 to the discharge plenum 90. Areas 91 and 94 illustrate that the housing is expanded axially beyond an end wall plane 95 in the respective areas 92 and 96.

Figure 7:
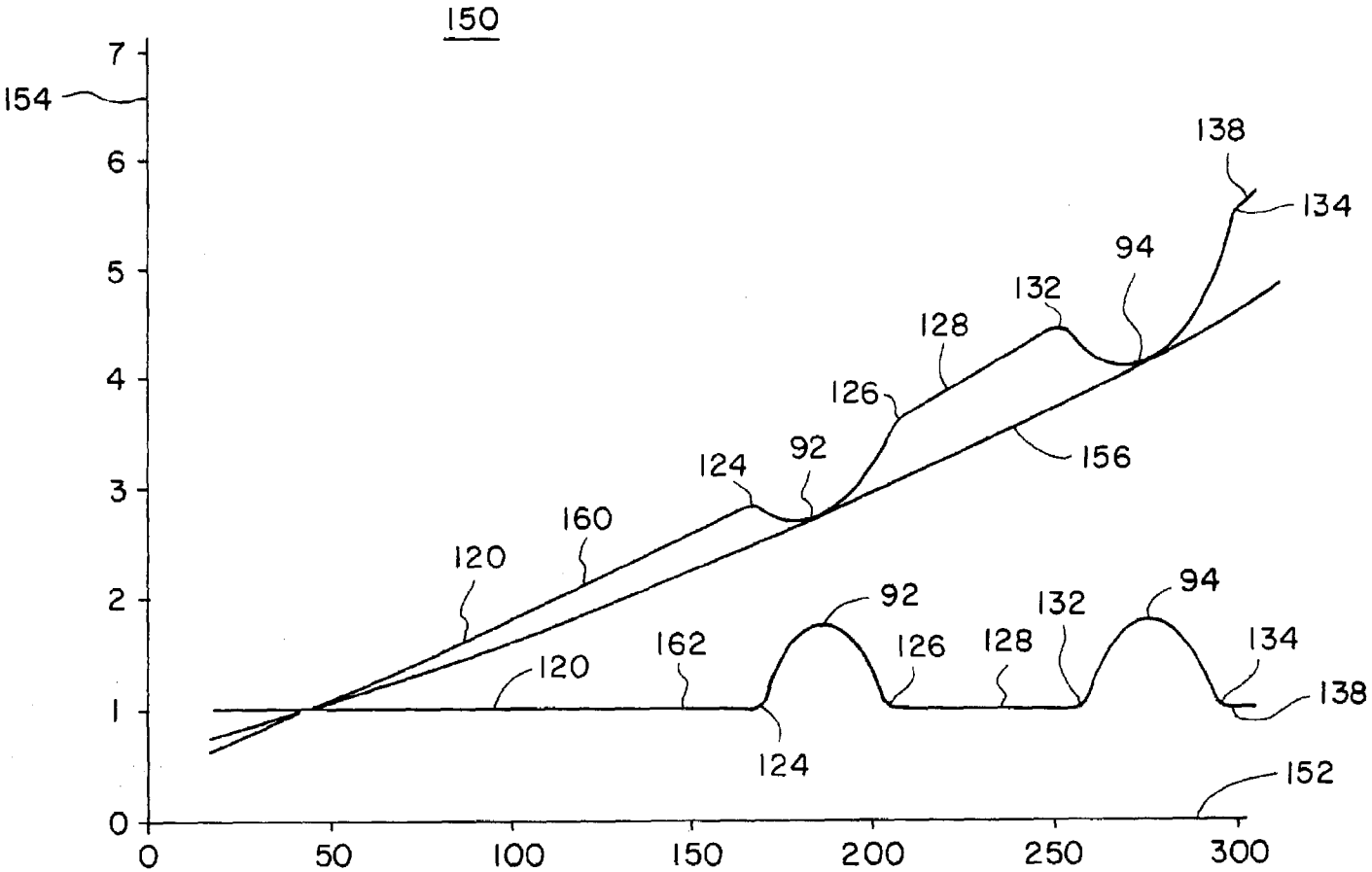
FIG. 7 is a representative graph of the distance from the cutoff versus the radial and axial distances for the embodiments of the present invention.

FIG. 7 is a graph 150 where an airflow distance in the discharge airflow path 82 from the cutoff 84 is illustrated by the ordinate 152, and where the axial and radial distances are illustrated by the abscissa 154. A line 156 illustrates the radial expansion of the prior art blower of FIG. 1. A line 160 illustrates the radial expansion of the blower of FIG. 2, noting that the radius actually contracts in the areas 92, 94. Line 162 illustrates that the axial dimension of the blower of FIG. 2 is substantially constant except in the areas 92, 94 where the axial dimension expands, generally in inverse proportion to the decrease in radial dimension. Effectively, the expansion axially of the airflow discharge path 82 allows the cross-sectional area to increase at a faster rate and carry more airflow per the illustration of FIG. 3 but without increasing the area of the footprint 42.

FIG. 8 shows the first preferred embodiment of the present invention wherein two different shapes are used to provide a discharge airflow path 82 with increasing cross-sectional area. These shapes are respectively illustrated in FIGS. 9 and 10 as a generally elliptical shape and as a generally rectangular shape.

FIG. 8 includes the improved blower housing 200 in accordance with the first embodiment of the present invention. The blower housing 200 is oriented about an axis 202 with an inlet 204 radially arranged about the axis 202 and a blower 206 radially spaced from the axis 202. The blower 206 is rotated about the axis 202 by some external means such as a motor (not shown) and draws air through the inlet 204 in an axial direction and then turns the air into a radial direction perpendicular to the axis 202 so that the air is moved through the blower 206 into a discharge plenum 208. A discharge airflow path 210 in the discharge plenum 208 commences at a cutoff 212 and travels around the blower 210 to a discharge outlet 214.

Like a conventional blower, the discharge airflow path 210 has a cross-sectional area which expands continuously. However, unlike a conventional blower, the discharge airflow path 210 alternates between expanding in a first cross-sectional shape 220 respectively shown as shapes 220A and 220B in FIGS. 9A and 9B and between expanding in a second cross-section shape 222 respectively shown as shapes 222A and 222B in FIGS. 10A and 10B. The first shape 220A is preferably elliptical or ovoid and has a smaller cross-sectional area, size for size, than the second shape 222A. The second shape 222 is preferably rectangular (and preferably with rounded corners 230) or may be formed in any other shape whose cross-sectional area is greater than a corresponding first shape, for example, such as ellipse or oval. The areas of expansion 224, wherein the blower housing 200 is expanded in the second shape 222A and 222B relative to the axis 202, are preferably located in approximately the same regions as the tangent lines I and II of a conventional blower. These areas of expansion 224 with the second shape 222A, 222B expand axially at corners 230, and allow the cross-sectional area of the discharge airflow path 210 to increase at a similar rate to the corresponding cross-sectional areas 226 of the discharge airflow path 210 using the first shape 220A, 220B even though the areas of expansion 224 do not increase in a radial dimension.

FIG. 11 illustrates the second preferred embodiment of the present invention wherein areas of radial expansion are intermixed with areas of axial expansion to provide a discharge airflow path 82 with increasing cross-sectional area. The shapes of the axial versus radial expansion are respectively illustrated in FIGS. 12 and 13 as rectangular shapes of substantially constant axial dimension and increasing radial dimension per FIGS. 12A and 12B, and as shapes of increased axial dimension but decreased radial dimension relative to the immediately surrounding radial cross-sections. The radial and axial dimensions of FIG. 13B relative to the respective radial and axial dimensions of FIG. 13A is increased. The axial dimensions of FIGS. 12A and 12B are about the same, while the radial dimension of FIG. 12B is greater than the radial dimension of FIG. 12A. The planes 95A and 95B are generally reflective of where a prior art end plate 30 might be located but are provided for illustrative purposes only and should not be considered to limit the claimed invention.

FIG. 11 includes the improved blower housing 300 in accordance with the second embodiment of the present invention. The blower housing 300 is oriented about an axis 302 with an inlet 304 radially arranged about the axis 302 and a blower 306 radially spaced from the axis 302. The blower 306 is rotated about the axis 302 by some external means such as a motor (not shown) and draws air through the inlet 304 in an axial direction and then turns the air into a radial direction perpendicular to the axis 302 so that the air is moved through the blower 306 into a discharge plenum 308. A discharge airflow path 310 in the discharge plenum 308 commences at a cutoff 312 and travels around the blower 310 to a discharge outlet 314.

The shape 320A illustrated in FIG. 12A has a cross-sectional area formed by the maximum radial dimension 340 and a maximum axial dimension 342. Similarly, the second cross-sectional shape 322A has a maximum radial dimension 344 and a maximum axial dimension 346 where the axial dimension 346 is greater than the axial dimension 342 and the radial dimension 344 is less than or equal to the radial dimension 340. The first shape 320B shown in FIG. 12B has a radial dimension 348 which is greater than the radial dimension 340 and has an axial dimension 350 which is substantially the same as the axial dimension 342. The second shape 322B shown in FIG. 13B has a radial dimension 352 which is generally less than or equal to a radial dimension 350 and has a axial dimension 354 which is greater than the axial dimension 350. The axial dimension 354 may be the same as the axial dimension 346 or may be greater than the axial dimension 346.

The cross-sectional area of the first shape 320A is defined by its radial dimension 340 times its axial dimension 342. This area is less than the cross-sectional area of the shape 322A (calculated based upon the actual shape used using geometry) which in turn is less than the cross-sectional area of the shape 320B. The area of the shape 322B (also calculated based upon actual shape used using geometry) is greater than the area 320B such that the cross-sectional area of the air discharge path progressively increases from the cutoff to the discharge as shown by the progression 12A, 13A, 12B and 13B. The end result is that for the same footprint, a greater volume of air can be moved more quickly and more quietly relative to a previous blower.

What has been described in this application is an improved blower housing for a centrifugal fan or the like which provides a larger discharge plenum for the same footprint. It will be apparent to a person of ordinary skill in the art that many improvements and modifications are possible to this blower including varying the shapes of the cross-sectional. Such modifications include the use of other shapes in the second embodiment and include the use of various materials in forming the blower. Other modifications include varying the extent and degree of the expansion axially versus the either radial contraction or radially maintaining the same distance. Additionally, while it is preferred that all transitions of one shape to another shape or from radial to axial dimension or vice versa should be smooth, it is conceivable that non-smooth or irregular transitions could be of value under certain circumstances. All such modifications and improvements are contemplated to full within the spirit and scope of the claimed invention.

What is desired to be secured for Letters Patent of the United States is set forth in the following claims:

The invention claimed is:

1. A blower comprising:

a housing having a discharge path portion that expands and contracts axially and radially;

a blower located in the housing; and an enclosed area, arranged about the blower and formed by the discharge path portion, having a cross-sectional area that expands continuously from a start to an end.

2. The blower of claim 1 further including:

an inlet;

an outlet;

a cutoff;

wherein the housing includes the inlet, the outlet, and the cutoff, and wherein the housing extends from the cutoff to the outlet in a first cross-sectional shape and includes at least a first aberrant portion of the housing which transitions from the first cross-sectional shape to a second cross-sectional shape, and then substantially resumes the first cross-sectional shape.

3. The blower of claim 2 wherein the inlet has an orientation centered around an axis, and further including a second aberrant portion, spaced approximately 90° from the first aberrant portion relative to the axis, which transitions from the first cross-sectional shape to a third cross-sectional shape, and then substantially resumes the first cross-sectional shape.

4. The blower of claim 3 wherein the first and second aberrant portions have dimensions that radially contract relative to the axis while axially increasing.

5. The blower of claim 4 wherein the first and second aberrant portions include a planar portion perpendicular to the axis.

6. The housing of claim 5 wherein the first cross-sectional shape is generally rectangular and the second cross-sectional shape is generally oval or elliptical.

7. The housing of claim 2 wherein the first cross-sectional shape is generally rectangular and the second cross-sectional shape is generally oval or elliptical.

8. The housing of claim 2 wherein the first aberrant portion radially contracts while axially increasing.

9. The blower of claim 1 further including:

a cutoff;

an outlet;

an axis;

the enclosed area forming an airflow path having the start at the cutoff, the end at the outlet, and an increasing cross-sectional area therebetween;

the discharge path portion arranged about and forming the airflow path and the outlet;

the discharge path portion providing at least a first section of the airflow path which increases in a radial dimension relative to the axis;

the discharge path portion providing a second section of the airflow path increasing in an axial dimension relative to the axis.

10. The blower of claim 9 wherein the discharge path portion includes at least a transitional portion linking the first and second sections.

11. The blower of claim 10 wherein an axial magnitude of the first section relative to the axis is constant.

12. The blower of claim 11 wherein the magnitude of the radial dimension of the second section of the airflow path relative to the axis does not increase in proportion to the cross-sectional area.

13. The blower of claim 12 wherein the first section has a cross-sectional shape which is generally rectangular when taken in a plane including the axis.

14. The blower of claim 13 wherein the second section has a cross-sectional shape which is generally elliptical or ovoid when taken in a plane including the axis.

15. The blower of claim 9 wherein the second section has a cross-sectional shape which is generally elliptical or ovoid when taken in a plane including the axis.

16. The blower of claim 15 wherein the first section has a cross-sectional shape which is rectangular when taken in a plane including the axis.

17. A blower housing comprising:

an axis about which the blower housing is oriented;

an inlet allowing the entrance of fluid in an axial direction for the blower housing;

a discharge for the blower housing discharging fluid in a radial direction;

a cutoff for the blower housing extending in the axial direction and located in the vicinity of the outlet;

a fluid flow path extending from the cutoff to the outlet wherein the fluid flow path is open in a radial inward direction to the axis to receive fluid from the inlet;

the fluid flow path having a progressively increasing cross-sectional area, the fluid flow path alternately expanding in the radial and axial directions;

wherein the fluid flow path contracts in the radial direction when expanding in the axial direction.

18. The blower housing of claim 17 wherein the fluid flow path remains at a constant axially dimension while expanding in the radial direction.

19. The blower housing of claim 18 wherein the fluid flow path has a first cross-sectional shape while expanding in the radial direction and a second cross-sectional shape while expanding axially.

20. The blower housing of claim 19 wherein the first shape is generally rectangular and the second shape is generally elliptical or ovoid.

21. The blower housing of claim 19 wherein the first shape is generally elliptical and the second shape is generally rectangular.

22. An air flow path comprising:

an axis;

a housing oriented about the axis;

at least a first airflow inlet centered about the axis in the housing;

an airflow outlet in the housing;

an airflow path between the inlet and the outlet, the airflow path including an entrance portion wherein airflow is generally parallel to the axis, a blower portion where airflow is perpendicular to the axis, and a scroll portion where the airflow is spiraling around the axis in a generally tangential increasing path;

the housing forming the inlet and the outlet and enclosing the airflow path, the airflow path having at least first and second cross-sectional shapes oriented in planes parallel to the axis, each shape having a radial dimension and an axial dimension, the first cross-sectional shape having at least first and second locations in the airflow path and the second cross-sectional shape having at least third and fourth locations in the airflow path; and wherein the axial dimension of the second cross-sectional shape at the second location relative to the first location increases as a function of the second cross-sectional shape's proximity in the airflow path to the outlet;

wherein the first cross sectional shape at the second location is between the third and fourth locations in the airflow path; and wherein at least a portion of the axial dimension of the first cross sectional shape at the second location is less than the axial dimension of the second cross-sectional shape at the first location.

23. The airflow path of claim 22 wherein the axial dimension of the first cross-sectional shape is a constant dimension throughout the airflow path.

24. The airflow path of claim 23 wherein the airflow path has a cross-sectional area which progressively increases from a beginning to the outlet.

25. The airflow path of claim 24 wherein the radial dimension of the first cross-sectional shape at the second location relative to the first location increases as a function of the cross-sectional shape's proximity in the airflow path to the outlet.

26. The airflow path of claim 24 wherein the degree of increase of the axial dimension of the second cross-sectional shape is such to maintain the progressively increasing cross-sectional area independent of the radial dimension.

27. An air moving apparatus comprising:

a blower for moving air and including a blower inlet and a blower outlet;

a housing arranged about the blower and having a housing inlet providing air to the blower inlet, an axis, a cutoff, and a housing outlet for receiving air from the blower outlet, the housing forming an airflow path from the blower outlet to the housing outlet wherein the airflow path has a cross-sectional area which progressively increases from the cutoff to the housing outlet and wherein the housing has a first portion where the housing expands the cross-sectional area in a radial direction relative to the axis while remaining constant in an axial direction relative to the axis; and wherein the housing includes a second portion which does not expand in a radial direction relative to the axis but does expand in an axial direction relative to the axis;

further including a third portion located where the cross-sectional area of the airflow path is greater than the second portion cross-sectional area and wherein the airflow path expands in a radial dimension in proportion to the cross-sectional area while remaining constant in an axial dimension.

28. The apparatus of claim 27 wherein the second portion is located in the airflow at a location having a greater cross-sectional area than the cross-sectional area of the first portion.

29. The apparatus of claim 28 including a fourth portion located where the cross-sectional area of the airflow path is greater than the third portion cross-sectional area and wherein the fourth portion does not expand in a radial dimension but does expand in an axial dimension.

30. The apparatus of claim 29 including a fifth portion located where the cross-sectional area of the airflow path is greater than the cross-sectional area of the fourth portion cross-section area and wherein the fifth portion expands in a radial dimension but remains constant in an axial dimension.

31. The apparatus of claim 30 wherein the axis is centered about the blower inlet.

32. A method of directing air from a blower discharge inlet to a blower discharge outlet comprising the steps of:

extending a discharge housing from the discharge inlet to the discharge outlet;

providing a first general cross-sectional shape of the discharge housing having a first axial and a first radial dimension;

providing a second general cross-sectional shape of the discharge housing having a second axial and a second radial dimension;

increasing the first radial dimension of the discharge housing wherever the first cross-sectional shape is provided; and decreasing the first radial dimension of the discharge housing whenever the second cross-sectional shape is provided.

33. The method of claim 32 including the further step of constantly increasing a cross-sectional area of the discharge housing from the discharge inlet to the discharge outlet.

34. The method of claim 33 wherein the first axial dimension of the first cross-sectional shape is less than the second axial dimension of the second cross-sectional shape.

35. The method of claim 32 wherein the first axial dimension of the first cross-sectional shape is less than the second axial dimension of the second cross-sectional shape.

36. The method of claim 32 including the further step of forming the second axial dimension to be greater than the first axial dimension.

37. The method of claim 36 including the further step of constantly increasing a cross-sectional area of the discharge housing from the discharge inlet to the discharge outlet.

38. A method of directing air from a blower discharge inlet to a blower discharge outlet comprising the steps of:

extending a discharge housing from the discharge inlet to the discharge outlet;

providing a first cross-sectional shape to the discharge housing;

providing a second cross-sectional shape to the discharge housing where the second cross-sectional shape differs from the first cross-sectional shape;

increasing a radial dimension of the discharge housing wherever the first cross-sectional shape is provided; and decreasing the radial dimension of the discharge housing whenever the second cross-sectional shape is provided.

39. The method of claim 38 including the further step of constantly increasing the cross-sectional area of the discharge housing from the discharge inlet to the discharge outlet.

40. The method of claim 39 wherein the first cross-sectional shape is generally rectangular and the second cross-sectional shape is generally elliptical.

41. The method of claim 39 wherein the first cross-sectional shape is generally elliptical and the second cross-sectional shape is generally rectangular.

42. The method of claim 38 wherein the blower is centered about an axis and the discharge housing includes at least one planar portion parallel to the axis.

43. An arrangement for directing air from a blower discharge inlet to a blower discharge outlet comprising:

means for extending a discharge housing from the discharge inlet to the discharge outlet;

means for providing a first cross-sectional shape to the discharge housing;

means for providing a second cross-sectional shape to the discharge housing where the second cross-sectional shape differs from the first cross-sectional shape;

means for increasing a radial dimension of the discharge housing wherever the first cross-sectional shape is provided; and means for decreasing the radial dimension of the discharge housing whenever the second cross-sectional shape is provided.

44. The arrangement of claim 43 including means for constantly increasing the cross-sectional area of the discharge housing from the discharge inlet to the discharge outlet.

45. The arrangement of claim 44 wherein the first cross-sectional shape is generally rectangular and the second cross-sectional shape is generally elliptical.

46. The arrangement of claim 44 wherein the first cross-sectional shape is generally elliptical and the second cross-sectional shape is generally rectangular.

47. The arrangement of claim 43 wherein the blower is centered about an axis and the discharge housing includes at least one planar portion parallel to the axis.

* * * * *